United States Patent [19]

Bramow et al.

[11] 4,398,087

[45] Aug. 9, 1983

[54] FLUID SIGNAL SQUARE ROOT EXTRACTOR

[75] Inventors: Scott B. Bramow, Oak Creek; Louis J. Crum, Port Washington; William J. Riebe, West Allis, all of Wis.

[73] Assignee: Johnson Controls, Inc., Milwaukee, Wis.

[21] Appl. No.: 390,515

[22] Filed: Jun. 21, 1982

Related U.S. Application Data

[63] Continuation of Ser. No. 108,589, Dec. 31, 1979, abandoned.

[51] Int. Cl.[3] ..... G06M 1/12

[52] U.S. Cl. ..... 235/200 PF; 137/489; 137/510

[58] Field of Search ..... 235/200 R, 201 PF; 137/489, 510; 98/1.5

[56] References Cited

U.S. PATENT DOCUMENTS 3,317,134 5/1967 Stearns ..... 235/200 R 3,662,779 5/1972 Weber et al. ..... 137/489

*Primary Examiner*—Benjamin R. Fuller

*Attorney, Agent, or Firm*—Andrus, Sceales, Starke & Sawall

[57] ABSTRACT

A square root signal extractor generates an output signal which is a square root function of an input signal. First and second diaphragm amplifiers have cascaded output chambers connected to a high gain output amplifier. The first and second amplifiers are connected as the non-inverting input and the inverting input respectively of the operational amplifier. A high gain output diaphragm amplifier is connected to the inverting amplifier output. The output diaphragm amplifier is constructed such that only a low level input pressure change is required to create a full swing of the output pressure. A non-linear input restrictor and a linear feedback resistor are connected to the input chamber of the inverting amplifiers. The feedback resistor has a significantly greater resistance than the input resistor. The non-inverting diaphragm amplifier is connected to the transmitter by a fluid repeater. A reference signal source is connected to the input restrictor and thus to the inverting input. The input restrictor is selected such that the differential pressure across the restricter is the square root of the flow. An adjustable fluid resistor is connected between the non-inverting and the inverting inputs which creates a flow path between the transmitter and reference source. The fluid repeater prevents loading of the transmitter.

9 Claims, 2 Drawing Figures

FLUID SIGNAL SQUARE ROOT EXTRACTOR

This is a continuation application of application Ser. No. 06/108,589, filed Dec. 31, 1979 now ABN.

BACKGROUND OF THE INVENTION

This invention relates to a fluid signal square root extractor and particularly to such an extractor operable to extract the square root of a flow-related pressure signal for producing an output pressure signal which is a linearized characteristic of pressure versus flow rate.

Various pneumatic and other fluid flow systems develop signals which are the square of the measured quantity or condition. For example, in the heating ventilating and air conditioning art, variable air volume systems are finding wider usage in the control of the environmental air for enclosed spaces. In such systems, outside air and recirculated air are selectively mixed, conditioned and exhausted to maintain room temperature. The control responds to demand changes by varying of the air volume and maintaining the necessary temperature condition. The controls for such systems often are based on sensing the air velocity in the supply and/or exhaust ducts. Conventional velocity pressure sensors and transmittors such as pilot tubes are widely used. Such sensors generate a differential pressure signal which is the square function of the air velocity. Pneumatic differential pressure transmittors generally have a highly linear output over the transmitter span, and thus transmit the nonlinear velocity pressure signal versus velocity. The necessary summing, comparing and similar processing such non-linear pressure signals is difficult because of the nonlinear relationship. Therefore, it is desirable to linearize the velocity scale such that direct and simple signal processing of the velocity related signals with other signals is possible. Although various square root extractors have been suggested, the devices have normally relied on mechanical systems requiring careful processing and quality control, and are generally relatively expensive. There is therefore a need for a simple, reliable and relatively inexpensive square root extractor for processing of fluid signals such as pneumatic signals encountered in heating, ventilating and air control conditioning equipment, as well as other fluid control systems.

SUMMARY OF THE PRESENT INVENTION

The present invention is particularly directed to a fluid circuit for converting of an input signal to a corresponding related square root output signal. Generally in accordance with the present invention, a plurality of interconnected and interrelated fluid signal amplifying devices are interconnected into a cascaded circuit to define a high gain operational amplifier having a non-linear passive network which develops an output signal which is a square root function of an input signal. The system preferably employs diaphragm amplifiers with suitable input and feedback resistors to create an economical square root extractor while maintaining accurate translation of the input signal, such that the system is economically produced, and adapted to installation and maintenance based on standard skills in the fluid art. Generally, in accordance with the present invention, first and second diaphragm amplifiers having cascaded output chambers are connected to a high gain output amplifier to create an operational amplifier. The feedback resistor has a greater resistance than the input resistor. A suitable non-linear input restrictor means and a linear feedback resistor are connected to the input chambers of the cascaded amplifiers. The first non-inverting input diaphragm amplifier connected to the transmitter is constructed as a one-to-one fluid repeator such that the output signal is a duplicate of the input signal. The inverting input operational amplifier is a proportional high gain switch having its input chamber connected to reference pressure. The output chamber is connected in series with the output of the direct acting diaphragm amplifier, and is connected as the input to a high gain output stage which is preferably a diaphragm amplifier constructed to function as a repeater. The output gain stage is specifically selected and constructed such that only a low level input pressure is required to create a full pressure swing at the output of the high gain stage but with the output signal directly proportional to such low level pressure signal.

The inverting switch amplifier remains closed and prevents transmission of an output until the level of the input signal rises above that of the reference signal. Thereafter a proportionally related output signal is transmitted which is a square root function of the input signal as the result of the nonlinear input-feedback network. In a practical implementation of the invention, the input signal is preferably coupled to the circuit through a fluid repeater. An adjustable fluid resistor is also connected between the non-inverting and the inverting inputs. The latter resistor provides a flow path between the input signal input and the reference source. A fluid repeater is preferably interposed between the input signal source and the operational amplifier input unit to prevent loading of the transmitter and the differential pressure signal.

The reference source preferably includes a fluid diaphragm regulator and diaphragm amplifier system such as shown in U.S. Pat. No. 4,199,101, MULTIPLE LOAD INTEGRATED FLUID CONTROL UNITS, filed on Jan. 26, 1979 by Scott B. Bramow et al and assigned to the same assignee as this application. The regulator is adjustable for establishing zero offset and provides a stable reference signal.

The input side of the output gain stage is also connected by a restrictor to ground to return the output to zero pressure in response to closing of the non-inverting or reverse acting diaphragm amplifier.

The present invention, particularly in the preferred construction, produces a square root output signal function using known fluid devices in an economical apparatus while maintaining a high degree of accuracy such as required for usage in the commercial practice.

DESCRIPTION OF THE DRAWING FIGURES

The drawings furnished herewith illustrates a preferred construction of the present invention in which the above advantages and features are clearly disclosed as well as others which will be readily understood from the following description.

In the drawings:

FIG. 1 is a schematic circuit of an air conditioning control system including a fluid square root extractor constructed in accordance with the teaching of the present invention; and FIG. 2 is a graphical illustration of the input/output pressure characteristics showing a typical square root curve generated by the transmitter and the linearized transform of that curve for the system shown in FIG. 1.

DESCRIPTION OF THE ILLUSTRATED EMBODIMENT

Figure 1:
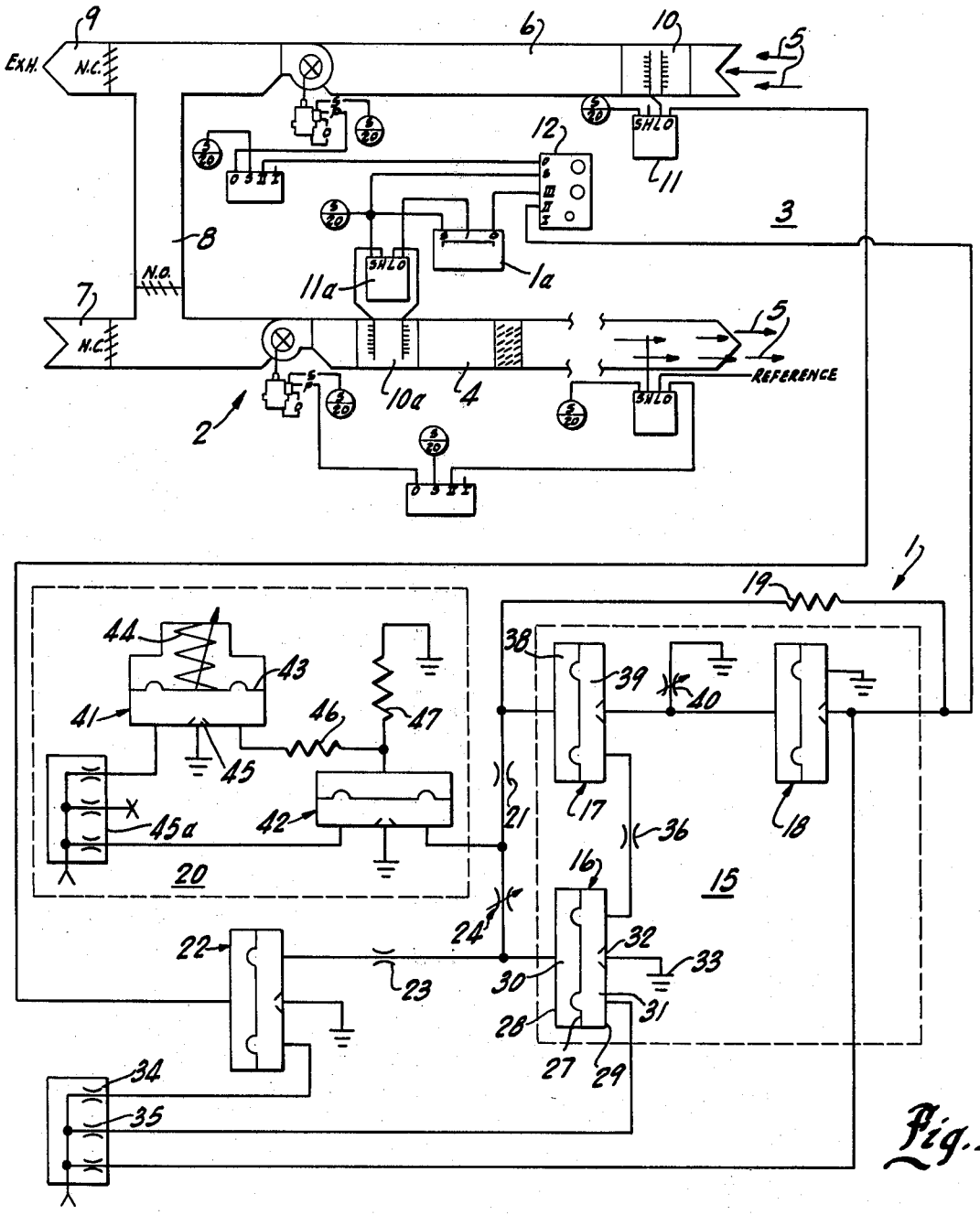

Referring to the drawing and particularly to FIG. 1, a schematic circuit of a preferred construction of a square root extractor constructed in accordance with the teaching of the present invention is schematically shown at 1. The extractor 1 is shown as part of a variable air volume control system 2 for monitoring and controlling of air supplied to an enclosed area or space 3. The variable air volume control system includes a supply duct 4 adapted to supply tempered or conditioned air 5 to the conditioned space. A corresponding volume or air is exhausted through exhaust duct 6. The air 5 supplied to the conditioned space 3 via the supply duct 4 is drawn from the exterior via an outdoor air input duct 7 and/or a recirculation of the exhaust air from the exhaust duct 8. Exhaust air not recirculated is discharged via an output duct 9. The control 2 includes various means responsive to the velocity of the air in the supply and/or the exhaust duct. In the variable air volume systems, for example, the air flow may be readjusted on the basis of the supply air demand, the flow in supply duct 4 and/or the exhaust air flow. For purposes of describing the present invention, a velocity responsive pressure transducer 10 and a transmitter 11 is shown associated with the exhaust duct 6 to develop a pressure signal related to the velocity of the supply air. The transmitter 11 is connected by the square root extractor 1 to a controller 12, the output of which is connected in any suitable manner to control the temperature and volume of air supplied to the enclosed space 3. The conditioned air supplied to the space 3 may be similarly monitored by a similar sensor 10*a* associated with the supply duct 4 and connected via transmitter 11*a* and extractor 1*a* to the controller 12. The present invention is particularly directed to the square root extractor. The other components will be readily understood by the ordinary worker in the art and are therefore only described in such detail as necessary to the full and clear description of the square root extractor.

The transducer 10 may be a well known Pitot tube connected to a suitable pressure signal transmitter 11. The output is a differential pressure signal which is a square function of the fluid velocity in the duct 7. Over the operating range of the transmitter 11, the output is linear. For example, in a practical heating, ventilating and air conditioning system, the output pressure signal will vary with flow over a range of three to fifteen PSI (pounds per square inch). The output pressure signal, however, changes as a nonlinear square function with velocity such as shown at 13 in FIG. 2. The sensed transmitted signal to the control unit 11 is desirably modified to produce a linear straight line relationship with velocity as shown at 14 in FIG. 2. The square root extractor 1 of the present invention serves to convert the output signal 13 of the transmitter 11 to a related square root output signal 14 and thus a linearized transform of the curve 13, as presently described.

Figure 2:
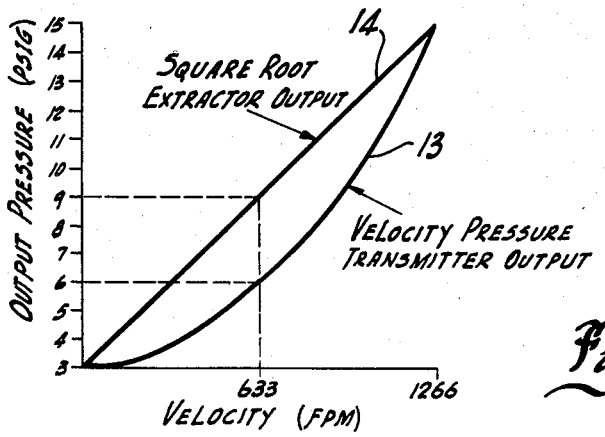

In the illustrated embodiment of the invention, proportional fluid switching and relay devices are interconnected with passive resistance devices to produce an operational amplifier 15, the output of which is the square root function of the input. Generally, in accordance with a teaching of the present invention, a direct acting non-inverting diaphragm amplifier 16 is cascaded with an inverting or reversed acting diaphragm amplifier 17 to define the noninverting and the inverting inputs of the fluid operational amplifier 15. The output of the inverting amplifier 17 is connected to an output gain stage, also shown as a diaphragm amplifier 18. Amplifier 18 is constructed to respond to a very low level input pressure change and establish a full pressure change in output which is directly proportional to the applied signal input signal. A fluid feedback resistor 19, which is larger than the input resistance as subsequently discussed, is interconnected between the output of the high gain stage 18 and the input to the inverting amplifier 17. A reference signal source 20 is connected to the inverting input in series with a non-linear input restrictor 21. The non-linear input restrictor 21 is selected to produce a pressure signal which is the square root of the flow in the restrictor, as more fully developed hereinafter. Signal source 20 is preferably adjustable to supply a regulated reference and which permits adjusting the system for a zero offset. The reference pressure source 20 is shown connected to the input of the inverting amplifier 17 in series with the input restrictor 21 and may be set for adjusting the offset of the operating response characteristic with a zero input signal from the transmitter 11. This permits maintaining a predetermined positive output signal in the presence of a zero input signal. As shown in FIG. 2, the system has been set for an offset of 3 PSI for a practical installation.

The transmitter 11 is coupled to the direct acting input in series with a flow isolating repeater 22 and a resistor 23. A span adjusting resistor 24 is preferably connected between the input resistor and the input of the non-inverting amplifier 16. The resistor 24 inserts a dead band within which the signal pressure may vary without change in the output. The resister 24 also establishes a flow path to the reference source 20, which is however isolated from transmitter 11 by the repeater 22 to prevent undesirable loading of the transmitter because such loading could adversely effect the linear output of the transmitter.

The direct acting amplifier 16 thus operates to transmit the level of the input signal to the inverting amplifier 17 which acts as a proportional high gain switch. The output of the inverting amplifier 17 is positive as long as the direct acting or non-inverting input signal exceeds the reference signal level applied to the inverting input amplifier 17. If the positive input drops below that of the inverting input, the amplifier 17 closes to prevent any further transmission of an output signal.

If the cascaded signal from the amplifier 16 is larger than the reference signal applied to the input chamber of the inverting amplifier 17, a corresponding proportional output signal is applied to the high gain output stage 18, which in turn provides a proportional output signal. The linear resistor 19, and the non-linear input 21, with the relative higher resistance of the linear feedback resistor 19, results in an output signal which is the square root of the input signal.

The pressure characteristic of the system is generally shown in FIG. 2. The output signal of the transmitter is a squared curve 13 of the transmitter pressure input signal versus the velocity which varies in the range or span between a positive 3 PSI and 15 PSI. Thus, the output pressure varies as the square of the velocity. For system pressure in the controller 12, a linearized output pressure vereus velocity characteristic such as shown at 14 is desired. The linearized curve 14 for the offset of 3 PSI, is defined by the equation:

$$P_o = \left(\sqrt{\frac{\text{Pin} - 3}{12}}\right) \times 12 + 3.$$

The input flow to the reference source is the square root of the differential input pressure; or $$Q_1 = K_1 \sqrt{\Delta P_1},$$

while the feedback flow is directly proportional to the feedback pressure or $Q_2 = K_2 P_2$. These two flows are equal and of an opposite sense relative to the inverting input to the operational amplifier. The differential output pressure $\Delta P_T$, equals the sum of the two differential pressures which establishes the final equation;

$$\Delta P_T = P_1 + K_1/K_2 \Delta P_1,$$

which reduces to the above equation. Thus, with the illustrated operational amplifier which has a high gain and wherein the feedback resistance is greater than the input resistance, the characteristic is essentially and for practical application a function of only the input resistances and the feedback resistance. For example, in a practical system, the input resistance changer over the 3 to 15 PSI signal, the input resistance changed from approximately 0.2 to 0.45 resistance which in relation to the feedback resistance of 1.18 gives a ratio of approximately 2 to 6. The ratio may of course vary and suitable resistors and orifices can be readily determined. The constant $K_1$ and $K_2$ are slightly different but with the feedback resistance larger than the input resistance, a single constant produces a practical output characteristic or response. The output is therefore a linearized translation of the transmitter signal.

Further, because of the flow through the feedback system to the reference signal source, the resistance of restrictor 21 should be substantially larger than the system input line resistance in order to avoid any possibility that signal line resistance will effect the set point or closed loop gain of the operational amplifier.

More particularly, in the illustrated embodiment of the invention the input amplifiers 16 and 17 are preferably constructed as convoluted diaphragm devices such as more fully disclosed in U.S. Pat. No. 3,662,779. Referring particularly to the direct acting input amplifier 16, a convoluted diaphragm 27 is secured between opposing body members 28 and 29 to define a closed input chamber 30 and an output chamber 31. The input chamber is connected to the fluid signal transmitter 11 in series with the dropping resister 23 and the fluid repeater 22. The output chamber 31 includes an orifice 32 which is connected to ground or reference atmosphere, as shown at 33. The orifice 32 is located in slightly spaced and opposed relation to the central portion of the diaphragm 27. As the diaphragm 27 moves toward the orifice 32, it serves to effectively close the orifice and reduce the flow to atmosphere, thereby increasing the pressure in chamber 31 to balance the pressure in the input chamber 30. If the diaphragm 27 moves into complete engagement with the orifice 32, it of course closes the orifice and transmits maximum or full supply pressure to the output line. As the diaphragm 27 moves away from the orifice, it opens the orifice and in the opposite extreme position, fully opens the orifice and connects the chamber 31 essentially to ground bypassing of the signal to ground and establishing a zero output. The intermediate positioning of the diaphragm provides for a corresponding proportionate output signal. The diaphragm amplifier 16 is constructed to function as a fluid repeater with the output signal an accurate one-to-one transform of the pressure at the input chamber 30. The input or supply port to chamber 31 is connected to a suitable air supply such as a common manifold 34 having a dropping resistor 35. The output port to chamber 31 is connected by a series resistor 36 to the output chamber of the inverting amplifier 17.

The inverting amplifier 17 and the output stage 18 are constructed as similar diaphragm amplifiers. Amplifier 17 functions as a proportional high gain switch which produces an output which is proportional to the difference in reference pressure in input chamber 38 and the condition-related pressure in the output chamber 39 as received from the direct acting amplifier 16. The diaphragm amplifier 18 is specially constructed to respond to a low level input pressure signal and to a established full pressure swing of its output in direct proportion to the output signal.

A midpoint bleed or by-pass resistor 40 is connected from ground 33 to the connection between the inverting amplifier 17 and the high gain amplifier 18. When the inverting amplifier 17 closes, the pressure in the input chamber of the high gain stage 18, which is also closed chamber, should be removed. Resistor 40 is an adjustable pin valve or the like which relieves the input chamber pressure and thereby returns the output signal to a zero output pressure.

The illustrated reference source 20 is similar to that disclosed in the previously identified United States Patent application and includes a spring loaded pressure regulator 41 having an output connected to the input chamber of a fluidic repeater 42 to provide a corresponding output reference signal connected by the input restrictor 21 to the inverting amplifier 17. The regulator 41 is a spring-loaded leak-port diaphragm unit 41 having a diaphragm 43 which is preloaded by an adjustable spring 44 to close an orifice in an output chamber 45. A supply port is connected to the supply through a suitable manifold unit **45*a* and an output port is connected to the input chamber of fluid repeater 42. The supply pressure builds in the output chamber 45 to the level necessary to balance the spring force at which point the leakage or bleed to ground through the orifice reduces the pressure to the level of the spring. The diaphragm regulator 41 produces a closely regulated pressure. The output pressure is applied to the input side of the fluid repeater through a pressure dividing resistance network. In the illustrated embodiment of the invention, a pair of resistors 46 and 47 of relatively large resistance are selected to drop the regulated 9 PSI to 3 PSI which is transmitted by the fluid repeater 42 to the operational amplifier 15. The resistor network not only serves to drop the pressure to the desired reference level but also serves to increase the sensitivity of the regulator adjustment to provide an accurate reference signal input to the operational amplifier 15**.

As noted previously, fluid flow exists between the input network including the reference source of the transmitter 11. The regulator as such is generally somewhat more sensitive to loading than the repeater. The repeater thus isolates the sources such that slight changes in the reference flow does not result in a practical detectable change in the regulated pressure supplied to the input of amplifier 17.

The present invention, by use of appropriate diaphragm units interconnected into an operational amplifier configuration and with the suitable non-linear passive regulator network, generates an output signal which is a square root function of the input signal. The input signal which is the square of the flow and is thereby converted to a corresponding straight line function 14.

The active components employed are known devices which are commercially available with linear and accurate characteristics. The passive elements are also known commercial elements having the desired linear and non-linear characteristics which can be readily constructed to produce the necessary accuracy. The device therefore provides a particularly practical implementation and application for developing a square root conversion of an input signal in an inexpensive and commercially producible product.

Various modes in carrying out the invention are contemplated as being within the scope of the following claims, particularly pointing out and distinctly claiming the subject matter which is regarded as the invention.

We claim:

1. A square root extractor unit for producing an output signal which is the square root of a differential input signal, comprising an operational amplifier unit including separate first and second fluid input amplifiers defining the inverting input and the non-inverting input of said amplifier unit, each of said amplifiers having input means with a high impedance and each producing a linearly related output of the input signal, said amplifiers being connected to each other between a supply input port and a signal output port for comparing the output signal of said first amplifier with said differential input signal, said amplifier unit including input resistance means adapted to be connected to the differential input signal and having a negative feedback resistance means connecting the output of the operational amplifier unit to the input of the operational amplifier unit, said input resistance means including a non-linear resistor establishing a differential input signal proportional to the square root of the flow and said feedback resistance means including only linear resistor means.

2. The square root extractor of claim 1 including a high gain output amplifier connected to said output signal port to produce said output signal, said feedback resistor means being connected between the high gain output amplifier and the input of the operational amplifier.

3. The square root extractor unit of claim 2 wherein said first and second amplifier are each diaphragm amplifiers having a dead-ended input chamber and an output chamber having a supply input port and a signal output port and a bleed orifice selectively opened and closed by said diaphragm.

4. The square root extractor of claim 3 wherein said output amplifier is a diaphragm unit having an output chamber with an input/output orifice and a reference port.

5. The square root extractor unit of claim 1 including a span adjustment resistance unit connecting the input of said amplifier unit to the input side of the non-linear input resistor.

6. The square root extractor unit of claim 5 wherein a regulated reference pressure source is connected to the input side of the non-linear input resistor.

7. The square root extractor unit of claim 6 wherein said reference pressure source includes a diaphragm fluid repeater having a dead-ended input signal chamber and an output chamber connected to input resistor and a spring-loaded diaphragm amplifier having an input/output chamber including an orifice selectively opened and closed by a diaphragm and a pressure divider network connecting the chamber to the input of fluid repeater.

8. A square root extractor unit for producing an output signal which is the square root function of an input signal, comprising an operational amplifier unit including a non-inverting fluid diaphragm amplifier and an inverting fluid diaphragm amplifier, said non-inverting fluid amplifier having a gain of one and including a diaphragm defining a dead-ended input chamber and an output chamber having a supply port and an output port and an orifice connected to a reference, said orifice being selectively opened and closed by said diaphragm, said inverting fluid amplifier having a gain greater than one and including a diaphragm defining a dead-ended input chamber and an output chamber having a supply port connected to the port of said non-inverting amplifier and an output orifice connected to said reference, said orifice being selectively opened and closed by said diaphragm, a high gain amplifier having a diaphragm defining a dead-ended input chamber connected to said output orifice and an output chamber having a supply/output orifice selectively opened and closed by the corresponding diaphragm and a reference port connected to reference pressure, a linear feedback resistor unit connecting the output orifice to the input chamber of the inverting amplifier, a reference signal source, a non-linear restriction connecting the reference signal source to the input chamber of the inverting amplifier, said non-linear restriction generating a differential pressure equal to the square root of the flow, and a signal input means connected to the non-inverting amplifier and operable to transmit said input signal to the dead-ended input chamber of the non-inverting amplifier.

9. The signal extractor unit of claim 8 including a flow sensitive signal source for developing said input signal, a fluid repeater having a dead-ended input connected to the source and a diaphragm-orifice controlled output chamber, a series resistor connecting said fluid repeater to said non-inverting amplifier for transmitting the input signal, and a span adjusting resistor connecting the non-inverting input to the reference signal source and to the input side of the non-linear input restriction.

* * * * *